United States Patent [19]

Suzuki et al.

[11] 4,088,611

[45] May 9, 1978

[54] BUILDER FOR DETERGENT

[75] Inventors: Hiroshi Suzuki, Mitaka; Yukio Ito, Tokyo; Yosiro Yasumoto, Fuchu, all of Japan

[73] Assignee: Agency of Industrial Science & Technology, Tokyo, Japan

[21] Appl. No.: 623,310

[22] Filed: Oct. 17, 1975

[30] Foreign Application Priority Data

Oct. 17, 1974 Japan ..... 49-119983

[51] Int. Cl.[2] ..... C11D 3/04

[52] U.S. Cl. ..... 252/541; 252/89 R; 423/385; 423/388

[58] Field of Search ..... 252/545, 89, 541; 423/388, 385

[56] References Cited

U.S. PATENT DOCUMENTS

| | | | |
|---|---|---|---|
| 2,302,598 | 11/1942 | Bruner | 423/388 |
| 3,368,978 | 2/1968 | Irani | 252/89 UX |
| 3,661,516 | 5/1972 | Hofmeister | 423/388 |

FOREIGN PATENT DOCUMENTS

| | | | |
|---|---|---|---|
| 647,316 | 12/1950 | United Kingdom | 423/388 |

*Primary Examiner*—Harris A. Pitlick
*Attorney, Agent, or Firm*—Armstrong, Nikaido, Marmelstein & Kubovcik

[57] ABSTRACT

Builder for detergent containing imidobissulfates.

1 Claim, No Drawings

BUILDER FOR DETERGENT

BACKGROUND OF THE INVENTION

This invention relates to novel and useful builder for detergent.

Builders, which improve surface active properties of detergent when blended with detergent, are required to have the desirable characteristics of excellent detergency, dispersing power, emulsifying characteristics, stability in hard water, rust-preventive power, chelating effect, non-environmental pollution characteristics and the like.

Heretobefore, inorganic compounds such as Glauber's salt or sodium sulfate, sodium metasilicate, soda ash and sodium tripolyphosphate have been effectively utilized as builders.

However, there have heretofore been no builder possessing all of the before-mentioned desirable characteristics. For instance, builders of phosphates have problems on waste water treatment and resources and builders of silicates have problems on stability in hard water.

An object of this invention is to overcome the problems and disadvantages of the conventional builders.

Another object of this invention is to provide novel builder having many advantages and no particular disadvantage as compared with the conventional builders.

Other objects and advantages of this invention will become apparent hereinafter.

SUMMARY OF THE INVENTION

The objects of this invention may be achieved by providing builder for detergent which comprises imidobissulfates of the general formula $$(MSO_3)_2NM'$$

(in which M represents cation selected from the group consisting of sodium, potassium, lithium and ammonium, and M' represents hydrogen atom or cation selected from the group consisting of sodium, potassium, lithium and ammonium).

DESCRIPTION OF THE PREFERRED EMBODIMENT

The imidobissulfates which are used in the practice of this invention are those shown as the above general formula and the typical compounds of them are, for example, neutral imidobissulfates such as diammonium imidobissulfates ($(NH_4SO_3)_2$ NH), disodium imidobissulfates ($(NaSO_3)_2NH\cdot 2H_2O$), dipotassium imidobissulfates and dilithium imidobissulfates sulfate, and basic imidobissulfates such as triammonium imidobissulfates ($(NH_4SO_3)_2NNH_4\cdot H_2O$), trisodium imidobissulfates ($(NaSO_3)_2NNa\cdot H_2O$, $(NaSO_3)_2NNa\cdot 12H_2O$) and trilithium imidobissulfates.

The builders of this invention may be used in combination with any known detergent.

The typical detergents to be used in combination with the builders of this invention are, for example, anionic surfactants such as sodium alkyl-sulfate and sodium alkylbenzenesulfonate, amphoteric surfactants such as alkyl betaine, nonionic surfactants such as polyoxyethylene alkylether, polyoxyethylene ester of higher fatty acid, polyoxyethylene alkylphenylether and polyoxyethylene sorbitan ester of fatty acid, cationic surfactants such as alkylpyridinium halide and alkyltrialkylammonium halide, and polymeric surfactants such as polyoxyethylene polyoxypropylene condensate and alkylpolyvinylpyridinium halide.

Addition amount of the builder of this invention to detergent is not essentially limited, but preferably within 20 ~ 500 parts by weight based on 100 parts by weight of the detergent.

Imidobissulfates of this invention may be easily prepared by various methods.

For instance, metal salts of imidobissulfuric acid may be prepared as the following equations using sulfur and ammonia.

$$S \xrightarrow{O_2} SO_2 \xrightarrow{O_2} SO_3 \quad (1)$$

$$2SO_3 + 3NH_3 \rightarrow (NH_4SO_3)_2NH \quad (2)$$

$$(NH_4SO_3)_2NH + 3MOH \rightarrow (MSO_3)_2NM + 2NH_3 + 3H_2O \quad (3)$$

(in which M represents Na, K or Li)

Preparation of imidobissulfates according to this method is quite economical since the raw materials are low priced sulfur and ammonia.

Diammonium imidobissulfate $(NH_4SO_3)_2NH$ may be prepared by introducing ammonia gas and then sulfurous acid gas into an aqueous solution containing ammonium sulfite to obtain triammonium nitridotrisulfate and heating the obtained nitridotrisulfate in ammonia gas at about 250° C under atmospheric pressure to ammonolyze and then followed by heating at about 300° C.

$$(NH_4SO_3)_3N + NH_3 \rightarrow (NH_4SO_3)_2NH + NH_4SO_3NH_2 \quad (4)$$

$$2NH_4SO_3NH_2 \rightarrow (NH_4SO_3)_2NH + NH_3 \quad (5)$$

The builders of this invention have various advantages as compared with the conventional builders and the total characteristics compare favorably with sodium silicate.

The following Table 1 shows comparative test results between the builders of this invention and the conventional builders.

TABLE 1

| | Builder | Property | pH (1%) | detergency | wetting power | dispersing power | emulsifying characteristics | rinsing property | stability in hard water (Mg) | the same (Ca) | active-alkalinity | anti-microbial action | rust preventive power | safeness property *1 | waste water problem *2 | Price | Total points to 100 points full mark |
|---|---|---|---|---|---|---|---|---|---|---|---|---|---|---|---|---|---|
| Conventional | sodium hydroxide | $NaOH$ | 120 | 4 | 2 | 3 | 3 | 2 | 2 | 2 | 5 | 4 | 2 | 1 | 1 | 5 | 62 |
| | sodium carbonate | $Na_2CO_3$ | 112 | 3 | 2 | 2 | 3 | 2 | 2 | 2 | 4 | 2 | 3 | 3 | 3 | 5 | 63 |
| | sodium hydrogen carbonate | $NaHCO_3$ | 84 | 2 | 2 | 2 | 2 | 3 | 1 | 1 | 2 | 1 | 3 | 5 | 5 | 4 | 51 |
| | sodium sesquicarbonate | $NaCO_3 . NaHCO_3 . 2H_2O$ | 99 | 2 | 2 | 2 | 2 | 3 | 2 | 2 | 2 | 2 | 3 | 4 | 4 | 3 | 51 |
| | sodium metasilicate | $Na_2SiO_2 . 5H_2O$ | 121 | 5 | 4 | 5 | 4 | 4 | 2 | 3 | 4 | 3 | 5 | 4 | 3 | 4 | 77 |
| | sodium sesquisilicate | $Na_2O . NaHSiO_2 . 5H_2O$ | 125 | 3 | 3 | 5 | 3 | 4 | 2 | 3 | 4 | 3 | 3 | 4 | 3 | 3 | 66 |
| | sodium orthosilicate | $2Na_2O . SiO_2 . 5H_2O$ | 128 | 4 | 3 | 4 | 3 | 3 | 2 | 3 | 4 | 4 | 3 | 4 | 3 | 3 | 66 |
| | sodium orthophosphate | $Na_3PO_4 . 12H_2O$ | 120 | 5 | 3 | 5 | 4 | 3 | 3 | 3 | 3 | 3 | 3 | 3 | 2 | 2 | 65 |
| | sodium pyrophosphate | $Na_4P_2O_7$ | 102 | 5 | 3 | 2 | 3 | 2 | 4 | 4 | 3 | 2 | 4 | 3 | 2 | 2 | 57 |
| | sodium tripolyphosphate | $Na_5P_3O_{10}$ | 97 | 5 | 3 | 4 | 4 | 3 | 4 | 4 | 2 | 2 | 4 | 3 | 2 | 1 | 63 |
| | sodium tetraphosphate | $Na_6P_4O_{13}$ | 87 | 4 | 3 | 4 | 3 | 3 | 4 | 4 | 1 | 1 | 5 | 3 | 2 | 2 | 60 |
| | sodium hexametaphosphate | $(NaPO_3)_6$ | 68 | 3 | 3 | 5 | 3 | 3 | 4 | 5 | 1 | 1 | 5 | 3 | 2 | 2 | 62 |
| | sodium sulfate | $Na_2SO_4 . 10H_2O$ | 7 | 2 | 2 | 3 | 3 | 3 | 3 | 3 | 1 | 1 | 3 | 5 | 5 | 4 | 59 |
| This invention | disodium imidobissulfate | $(NaSO_3)_2NH . 2H_2O$ | 7 | 3 | 2 | 4 | 3 | 3 | 3 | 3 | 1 | 2 | 4 | 4 | 4 | 3 | 60 |
| | trisodium imidobissufate | $(NaSO_3)_2NNa . H_2O$ | 109 | 4 | 2 | 4 | 3 | 3 | 4 | 3 | 4 | 2 | 4 | 5 | 4 | 3 | 69 |

*1 Toxicity, Skin irritation etc.
*2 increase in pH, mutritious source of alga

In the above Table 1, the figures 5 ~ 1 mean the followings,

5 : excellent, 4 : very good, 3 : good,
2 : not good, 1 : bad.

The builders of this invention have different bonding >NH in the molecule from the conventional builders and are widely utilized in combination with various detergents. Since the builders of this invention may be easily prepared from sulfur and ammonia, the manufacturing costs are quite low and their sulfur contents are relatively high, for instance, 25% in trisodium imidobissulfate [$(NaSO_3)_2NNa \cdot H_2O$] as compared with 10% in sodium sulfate and, accordingly, this invention is quite important in view of available exploitation of sulfur.

EXAMPLE 1

This example shows test results of builder effect of imidobissulfates according to this invention to polyoxyethylene nonyl-phenyl ether (12 mols adduct)

A : Sample

An aqueous (distilled water) solution containing 0.25% of surfactant (polyoxyethylene nonylphenyl ether and 0.75% of builder was prepared and used as sample.

Since neutral imidobissulfates are neutral and somewhat unstable, the corresponding basic salts are used by adding in a small amount.

B : Testing method (1) surface tension: measured by means of du Nouy surface tensiometer at 22° ~ 24° C.

(2) emulsifying characteristics: measured by putting 0.5 ml of sample and 0.5 ml of oil (1.5 cm high) into a test tube with a cap (8 × 50 mm), setting and leaving it alone in a beaker in water bath for 5 minutes, shaking it vertically under the condition of 25 cm/20 times/10 seconds, leaving it alone in water bath of 90° C for 30 minutes, and then measuring the height of the emulsified phase.

Evaluation basis is as follows.

| Evaluation | height of emulsified phase (cm) |
|---|---|
| 5 | 1.5 ~ |
| 4 | 1.0 ~ 1.4 |
| 3 | 0.5 ~ 0.9 |
| 2 | 0.1 ~ 0.4 |
| 1 | 0 |

As oils, cottonseed oil (HLB10) and liquid paraffin (HLB12) were used.

(3) dispersing power: measured by putting 1 ml of sample and about 3 mg of carbon black into a test tube (the same as in (2)), shaking it vertically under the condition of 25 cm/20 times/10 seconds, and measuring the height (h) of the dispersed phase and shade of color. temperature: 22° ~ 24° C Evaluation basis is as follows

| Evaluation | height h (cm) | shade of color |
|---|---|---|
| 5 | 2.8 ~ 3.0 | strongly deep |
| 4 | 2.0 ~ 2.7 | very deep |
| 3 | 1.0 ~ 1.9 | deep |
| 2 | 0.1 ~ 0.9 | light |
| 1 | 0 | transparent |

(4) solubilizing power: measured by putting every 0.5 ml of sample into four test tubes (the same as in (2)), putting 0.008 ml, 0.011 ml, 0.014 ml and 0.017 ml of isoamyl alchol into each test tube, leaving them alone in hot water of about 50° C for 5 minutes, shaking them vertically under the condition of 25 cm/60 times/30 seconds, leaving them alone in hot water of 30° C for 5 hours, and observing the solubilization state (shaking in 3 hours in the same manner).

Evaluation basis depends on maximum solubilized amount of alcohol.

| Evaluation | solubilized amount (ml) |
|---|---|
| 5 | 0.018 ~ |
| 4 | 0.015 ~ 0.017 |
| 3 | 0.012 ~ 0.014 |
| 2 | 0.008 ~ 0.011 |
| 1 | ~ 0.007 |

(5) detergency: measured by putting 2 ml of sample solution into a test tube with a cap (8 ~ 10 ml), dipping 3 pieces of artificially contaminated clothes (8 × 8 mm) into the solution at 30° C for 2 minutes, shaking it vertically under the condition of 25 cm/40 times/20 seconds, bringing out the washed clothes, drying them, and measuring degree of white color of them by means of reflectance tester and observing turbidity of the waste water. Contaminated clothes were prepared by contaminating cotton clothes with a solution dissolued liquid paraffin (65%) and cottonseed oil (35%) and dispersed carbon black in carbon tetrachloride, according to J. Am. Oil Chemists' Soc. 28, 96 (1951).

Evaluation basis is as follows.

| Evaluation | Reflectance % | Waste Water |
|---|---|---|
| 5 | 30.1 ~ | strongly black |
| 4 | 28.5 ~ 30.0 | somewhat black |
| 3 | 26.8 ~ 28.4 | dark |
| 2 | 25.1 ~ 26.7 | pale dark |
| 1 | ~25.0 | slightly muddy |

(6) wetting power: measured by putting 3 ml of sample into a test tube (10 ml), putting a test piece (felt, 5 × 5 mm) softly on the liquid surface, and measuring the time taken to sink the piece from the liquid surface into the liquid. temperature: 22° ~ 24° C Evaluation basis is as follows.

| Evaluation | time (sec.) |
|---|---|
| 5 | ~3.0 |
| 4 | 3.1 ~ 20.0 |
| 3 | 20.1 ~ 50.0 |
| 2 | 50.1 ~ 200.0 |
| 1 | 200.1 ~ |

(7) rust preventive power: measured by putting 4 ml of sample solution into a test tube with a cap (10 ml), dipping metal piece (wire of about 20 mm length or metal plate of 3 × 20 × 1 mm) into the solution, leaving it alone in hot water of 90° C for 24 hours, and observing the piece.

Evaluation basis is as follows.

| Evaluation | surface state |
|---|---|
| 5 | no change |
| 4 | slight decrease in luster, slightly rust spot, solution was slightly muddy |
| 3 | somewhat increased change of 4 |
| 2 | generated rust on half of the surface |
| 1 | generated rust on all the surface precipitation was occured |

C: Test results

The test results are as follows.

TABLE 2

(builder effect to polyoxyethylen nonylphenyl ether)

| builder | surface active property | surface tension dyne/cm | emulsifying characteristics: cotton-seed oil | emulsifying characteristics: liquid paraffin | emulsifying characteristics: * | dispersing power: black | detergency: wash liquid | detergency: cotton cloth | detergency: * | solubilizing power: isoamyl alcohol | wetting power: felt | rust-preventive power: soft iron | steel | aluminum | copper | brass | phosphor-bronze | zinc-plate | tin-plate | solder | lead | * |
|---|---|---|---|---|---|---|---|---|---|---|---|---|---|---|---|---|---|---|---|---|---|---|
| none | | 36.0 | 3 | 2 | 2.5 | 4 | 2 | 2 | 2 | 2 | 5 | 4 | 3 | 2 | 4 | 3 | 3 | 2 | 4 | 3 | 3 | 3.1 |
| sodium sulfate | | 37.1 | 3 | 2 | 2.5 | 2 | 2 | 3 | 2.5 | 4 | 4 | 4 | 4 | 3 | 5 | 4 | 5 | 1 | 4 | 2 | 3 | 3.5 |
| sodium tripolyphosphate | | 35.9 | 5 | 2 | 3.5 | 3 | 3 | 4 | 3.5 | 5 | 4 | 5 | 4 | 2 | 4 | 4 | 4 | 1 | 4 | 2 | 3 | 3.3 |
| sodium metasilicate | | 35.2 | 5 | 4 | 4.5 | 4 | 3 | 4 | 3.5 | 4 | 4 | 5 | 5 | 4 | 3 | 5 | 5 | 5 | 5 | 5 | 3 | 4.5 |
| diammonium imidobissulfate | | 37.0 | 4 | 3 | 3.5 | 2 | 2 | 2 | 2 | 5 | 4 | 5 | 2 | 4 | 5 | 5 | 5 | 1 | 4 | 3 | 5 | 3.9 |
| disodium imidobissulfate | | 33.9 | 5 | 2 | 3.5 | 4 | 3 | 3 | 3 | 4 | 4 | 5 | 4 | 2 | 5 | 4 | 5 | 1 | 3 | 4 | 3 | 3.6 |
| triammonium imidobissulfate | | 34.9 | 4 | 2 | 3 | 3 | 3 | 3 | 3 | 3 | 4 | 3 | 4 | 3 | 3 | 3 | 4 | 1 | 3 | 3 | 3 | 3.0 |
| trisodium imidobissulfate | | 34.2 | 4 | 4 | 4 | 3 | 4 | 4 | 4 | 4 | 4 | 4 | 5 | 2 | 4 | 5 | 5 | 2 | 3 | 4 | 2 | 3.6 |

*mean value

EXAMPLE 2

The experiments were conducted in the same manner set forth in Example 1 by using sodium dodecyl sulfate as detergent.

The test results are shown in Table 3.

It is apparent from the test results of Example 1 and 2 that imidobissulfates of this invention show builder effects comparing favorably with the conventional builders such as sodium sulfate, sodium tripolyphosphate and sodium metasilicate.

What is claimed is:

1. A detergent composition consisting essentially of a synthetic detergent and, as a builder for the detergent, an imidobissulfate having the formula $(NaSO_3)_2N \cdot Na$, said builder being present in an amount of from 20 to 500 parts by weight per 100 parts of the detergent.

* * * * *

TABLE 3

(builder effect to sodium dodecyl sulfate)

| builder | surface active property | surface tension dyne/cm | emulsifying characteristics: cotton-seed oil | emulsifying characteristics: liquid paraffin | emulsifying characteristics: * | dispersing power: carbon black | detergency: wash liquid | detergency: cotton cloth | detergency: * | solubilizing power: isoamyl alchol | wetting power: felt | rust-preventive power: soft iron | steel | aluminum | copper | brass | phosphor-bronze | zinc-plate | tin-plate | solder | lead | * |
|---|---|---|---|---|---|---|---|---|---|---|---|---|---|---|---|---|---|---|---|---|---|---|
| none | | 38.7 | 4 | 1 | 2.5 | 1 | 3 | 2 | 2.5 | 1 | 4 | 3 | 3 | 3 | 2 | 2 | 2 | 2 | 4 | 4 | 4 | 2.9 |
| sodium sulfate | | 38.4 | 4 | 3 | 3.5 | 1 | 3 | 3 | 3 | 5 | 4 | 3 | 4 | 3 | 3 | 3 | 3 | 1 | 5 | 3 | 3 | 3.1 |
| disodium imidobissulfate | | 32.3 | 4 | 1 | 2.5 | 4 | 3 | 3 | 3 | 4 | 4 | 3 | 4 | 2 | 5 | 4 | 5 | 1 | 4 | 2 | 3 | 3.3 |
| trisodium imidobissulfate | | 36.6 | 4 | 2 | 3 | 5 | 4 | 4 | 4 | 5 | 4 | 4 | 4 | 4 | 5 | 4 | 4 | 3 | 4 | 4 | 3 | 3.9 |

*mean value